US010639650B2

(12) United States Patent
Mackel et al.

(10) Patent No.: US 10,639,650 B2
(45) Date of Patent: May 5, 2020

(54) METHOD FOR MONITORING AND/OR REGULATING THE OPERATION OF A CENTRIFUGE

(71) Applicant: GEA MECHANICAL EQUIPMENT GMBH, Oelde (DE)

(72) Inventors: Wilfried Mackel, Lippetal-Herzfeld (DE); Kathrin Quiter, Drensteinfurt (DE); Thomas Bathelt, Oelde (DE)

(73) Assignee: GEA MECHANICAL EQUIPMENT GmbH, Oelde (DE)

( * ) Notice: Subject to any disclaimer, the term of this patent is extended or adjusted under 35 U.S.C. 154(b) by 392 days.

(21) Appl. No.: 15/525,828

(22) PCT Filed: Oct. 23, 2015

(86) PCT No.: PCT/EP2015/074615
§ 371 (c)(1),
(2) Date: May 10, 2017

(87) PCT Pub. No.: WO2016/074905
PCT Pub. Date: May 19, 2016

(65) Prior Publication Data

US 2017/0312763 A1 Nov. 2, 2017

(30) Foreign Application Priority Data

Nov. 11, 2014 (DE) ..... 10 2014 116 404

(51) Int. Cl.
*B04B 11/04* (2006.01)
*B04B 9/12* (2006.01)
(Continued)

(52) U.S. Cl.
CPC ..... *B04B 11/04* (2013.01); *B04B 9/10* (2013.01); *B04B 9/12* (2013.01); *B04B 13/00* (2013.01)

(58) Field of Classification Search
CPC .. B04B 11/04; B04B 9/10; B04B 9/12; B04B 13/00
(Continued)

(56) References Cited

U.S. PATENT DOCUMENTS 3,541,844 A * 11/1970 Stover ..... G01L 1/22 73/761
5,665,925 A * 9/1997 Gerteis ..... B04B 3/025 494/10
(Continued)

FOREIGN PATENT DOCUMENTS

CA 2203539 C * 8/2003 ..... G01B 17/04
CN 2307634 Y 2/1999
(Continued)

OTHER PUBLICATIONS

International Search Report dated Jan. 27, 2016 in related International Application No. PCT/EP2015/074615.
(Continued)

*Primary Examiner* — Walter D. Griffin
*Assistant Examiner* — Shuyi S. Liu
(74) *Attorney, Agent, or Firm* — Patent Portfolio Builders PLLC

(57) ABSTRACT

A method for monitoring, controlling, and/or regulating the operation of a centrifuge, in particular a separator, during the centrifugal processing of a product, in particular when clarifying a product and/or when separating a product into different liquid phases. The centrifuge has a drum which can be rotated by a drive spindle, a drum mounting, and a drive motor. Force measurements are performed using one or more force sensors and analyzed, and an output is provided in the event of a deviation from a specified behavior and/or the analyses are used for or during the control and/or regulation of the operation of the centrifuge.

20 Claims, 4 Drawing Sheets

(51) Int. Cl.
*B04B 13/00* (2006.01)
*B04B 9/10* (2006.01)

(58) Field of Classification Search
USPC ..... 494/1, 2, 5, 7, 10, 83
See application file for complete search history.

(56) References Cited

U.S. PATENT DOCUMENTS

| | | | | |
|---|---|---|---|---|
| 5,948,271 | A * | 9/1999 | Wardwell | B04B 1/20 210/143 |
| 6,314,824 | B1 * | 11/2001 | Gerteis | B04B 3/025 73/865 |
| 7,102,621 | B2 * | 9/2006 | Roberts | G06F 3/041 345/156 |
| 2007/0027014 | A1 | 2/2007 | Ryu et al. | |
| 2014/0235420 | A1 * | 8/2014 | Hilpert | B04B 11/04 494/10 |

FOREIGN PATENT DOCUMENTS

| | | | | |
|---|---|---|---|---|
| CN | 102413940 | A | 4/2012 | |
| CN | 202301673 | U | 7/2012 | |
| CN | 203342956 | U | 12/2013 | |
| DE | 2626763 | A1 * | 12/1977 | B04B 11/04 |
| DE | 2626763 | A1 | 12/1977 | |
| DE | 4111933 | C1 | 6/1992 | |
| DE | 102008062055 | A1 | 6/2010 | |
| JP | S51131961 | A | 11/1976 | |
| JP | H04166250 | A | 6/1992 | |
| JP | 2002248377 | A | 9/2002 | |
| WO | 2010098714 | A1 | 9/2010 | |

OTHER PUBLICATIONS

Written Opinion dated Jan. 27, 2016 in related International Application No. PCT/EP2015/074615.

Office Action dated Jun. 24, 2019 in related/corresponding CN Application No. 201580057607.6 (References from OA not cited herewith have previously been made of record).

Office Action dated May 28, 2019 in related/corresponding JP Application No. 2017-517246.

* cited by examiner

METHOD FOR MONITORING AND/OR REGULATING THE OPERATION OF A CENTRIFUGE

BACKGROUND AND SUMMARY OF THE INVENTION

Exemplary embodiments of the invention relate to a method for monitoring and/or controlling and/or regulating the operation of a centrifuge, in particular a separator, during the centrifugal processing of a product, in particular when clarifying a product and/or when separating a product into various liquid phases.

Such methods are known per se from the prior art, such as German patent document DE 4111933 C1, which discloses emptying monitoring on the basis of a measurement of the increase of the current of the drive motor of the drum or a drop of the speed of the drum. Another method is disclosed in German patent document DE 102008062055 A1, which discloses a method for detecting a machine state, in which an analysis of measured values is performed to detect the machine state, wherein the machine controller assigns and evaluates the measured value of a sensor of a machine component depending on the control state.

In relation to this prior art, a further method for monitoring and/or regulating the operation of a centrifuge is to be provided, which enables novel operating modes and analyses in relation to the prior art.

According to exemplary embodiments, force measurements are performed and analyzed using one or more force sensors. In the event of a deviation from a predefined behavior, an output is performed. Optionally or alternatively, the force measurements or the analyses of the force measurements are used during the control and/or regulation of the operation of the centrifuge.

According to the invention, the running operation of the centrifuge during the centrifugal processing of a product is therefore monitored by one or more force measurements using one or more force sensors. A regulation of the operation is then also optionally or alternatively performed. Error recognition is possible and preferably an optimization of the operation of the centrifuge is also possible by way of a regulation depending on predefined limits of the force measurement(s).

For example, detecting axial deflections of the drive spindle using sensors is known from the prior art. In this manner, the operation of a centrifuge can be monitored or at least additionally monitored in a simple manner. The monitoring and control using force sensors, however, provides an alternative possibility for monitoring and controlling in relation to the known methods. Moreover, it may be combined with the known methods. Force sensors or force pickups represent a simple possibility for monitoring and/or controlling and regulating the operation of the centrifuge, which offers different and/or further advantages in relation to the prior art.

Force washers and/or shear force transducers are preferably used to carry out the force measurements.

Inferences about the operating state can be drawn from the measurement data of the force measurements, for example, at spring elements on the base elements and/or on the drum mounting of the centrifuge.

Machine and process and/or method actions for operational optimization are preferably initiated and the effects thereof are monitored by the machine controller (a control and preferably regulating unit) depending on the analysis of the measurement by the machine controller, optionally further state variables of the centrifuge, and optionally the respective method processes.

A centrifuge, in particular a separator having vertical axis of rotation, is preferably set up on four elastic (base) elements, in which a drum is supported on elastic support bearings in the region of the drum mounting. In this way, a movement of the supported system is possible in narrow limits in each case. These movements result from the machine-dynamic state but also the process state of the centrifuge. The static and dynamic forces acting on the base elements and/or the support bearings at the drum mounting can each be determined or measured via the force sensors in the form of force measurements.

The force measurements are preferably each set in relation to one or more reference measurement(s), whereby a judgment of parameters of the present state of the machine, the method process, and/or the respective changes thereof becomes possible. Machine functions, a change of the operating speed, and/or method process functions such as emptying or changing the feed quantity are then initiated depending on static or dynamic limiting values. For this purpose, it is advantageous if a calibration run is carried out once or repeatedly to carry out the reference measurement.

BRIEF DESCRIPTION OF THE DRAWING FIGURES

The invention will be described in greater detail hereafter with reference to the drawing on the basis of an exemplary embodiment.

DETAILED DESCRIPTION

Figure 1:
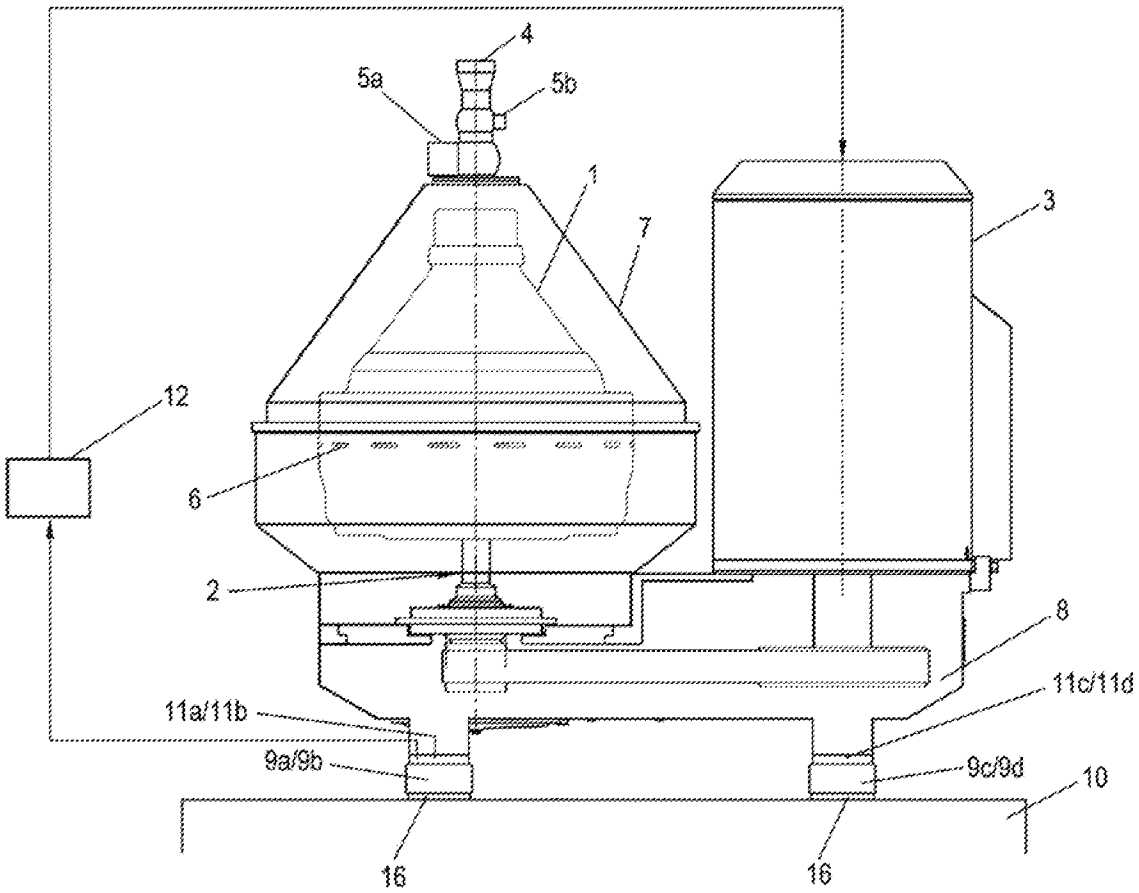
FIG. 1 shows a greatly simplified schematic illustration of a first separator for the centrifugal processing of a product.

FIG. 1 shows a schematic illustration of a separator for the centrifugal processing of a product, in particular for clarifying a product of solids (or for concentrating such a phase) and/or for separating a product into various liquid phases.

The separator shown in FIG. 1—which is preferably designed for continuous operation—has a rotatable drum 1 (only shown schematically here), preferably having a vertical axis of rotation. A separating plate assembly (not shown here) can be arranged in the drum 1. The drum 1 furthermore has a drive spindle 2, which is drivable via a drive connection using a drive motor 3. The drive motor 3 could also be arranged as a direct drive in direct extension of the drive spindle (not shown here).

A feed line 4 for a product to be processed leads into the drum 1. Liquids of various density and possibly solids can be conducted (schematically shown) through one or more drain lines 5*a*, 5*b* and possibly solid discharge openings 6 out of the drum 1. Preferably, valves which can be controlled (and preferably throttled) are provided (not shown here) in the feed line 4 and the drain line(s) 5*a* and possibly 5*b*. The drum 1 is enclosed by a hood 7.

The rotatable drum 1 and preferably the drive/motor 3 (and possibly further elements such as the hood 7) are arranged on a machine frame 8 and supported thereon. The machine frame 8 is in turn set up on a floor, in particular a foundation 10 (see FIGS. 1 and 2) via one or here more (preferably three or four) base elements 9*a, b, c, d*, which have a spring element or can be designed as a round bearing 14 as here, for example.

Figure 3:
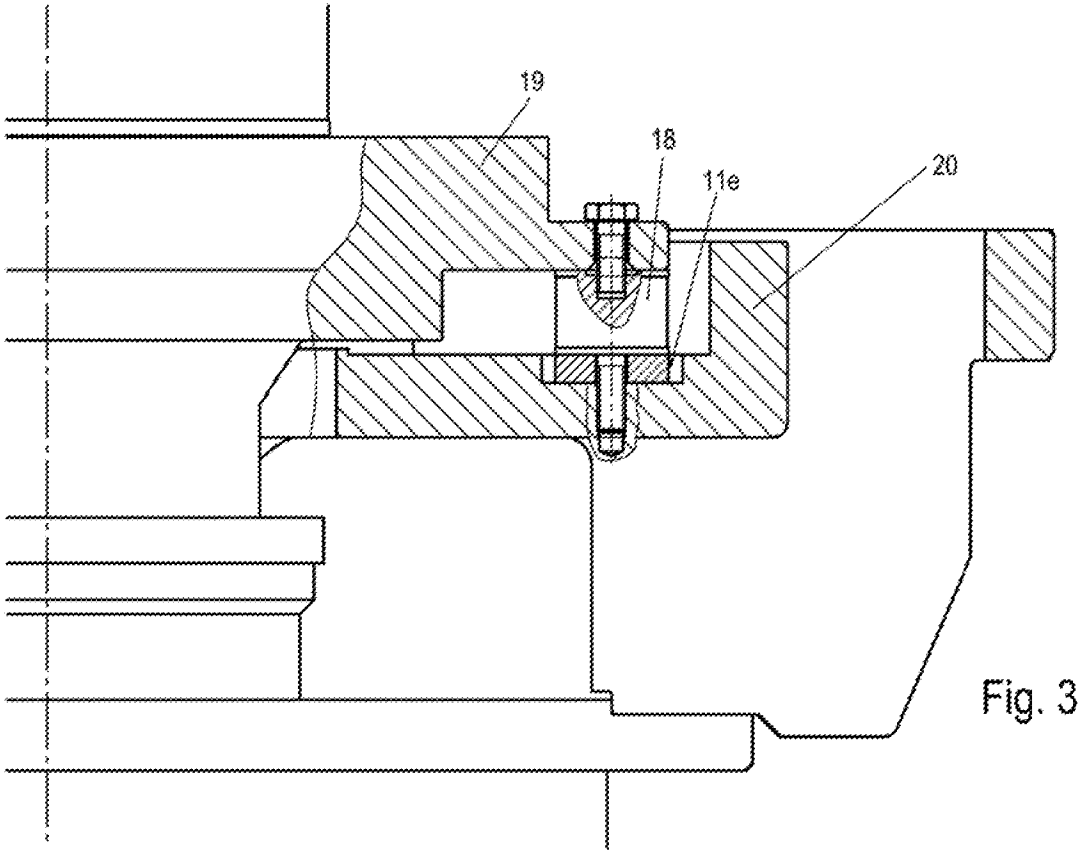
FIG. 3 shows a view, which is in partial section and enlarged and in greater detail, of a further partial region of the separator from FIG. 2.

During operation, i.e., during a rotation of the drum 1, one or more forces are measured (step I in FIG. 4) at each of one or more force sensors 11*a* to 11*d* and/or 11*e* (see FIG. 3).

The force sensors or force transducers 11*a*-11*d* and/or 11*e* can be provided in various regions of the centrifuge, in particular at points at which elements of the rotating system are springily supported on a counter bearing, i.e., in regions in which a movement of the rotating system is permitted or takes place in narrow limits. These movements result from the machine-dynamic state or also the process state or the changes of the centrifuge thereof. The static and dynamic forces acting in this manner can be measured via the force measurement.

Figure 2:
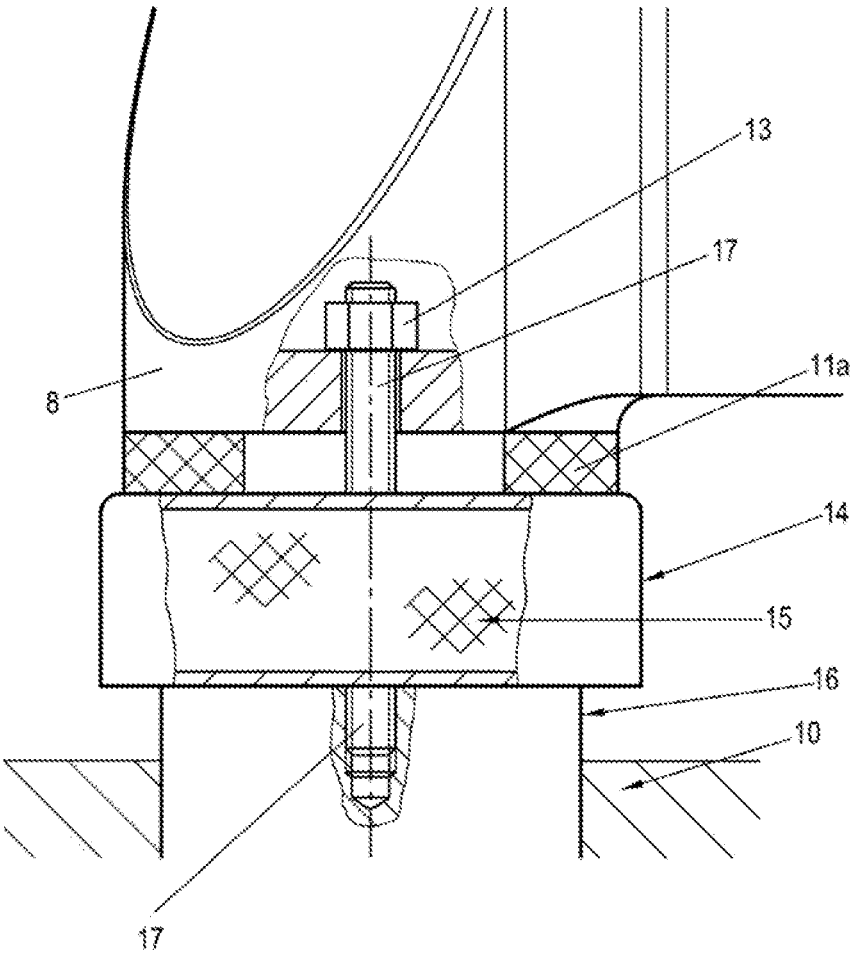
FIG. 2 shows a view, which is in partial section and enlarged and in greater detail, of a partial region of the separator from FIG. 2.

According to a first exemplary embodiment, one or more, particularly preferably all of the base elements 9*a-d* is/are each assigned one of the force sensors 11*a, b, c, d* for carrying out the force measurements at the respective base elements 9*a*-9*d* (FIGS. 1, 2).

Alternatively or additionally, in a second exemplary embodiment, one or more, particularly preferably at least 3 circularly-symmetrically arranged elastic support bearings 18 in the region of a drum mounting (not shown here) are each assigned one of the force sensors 11*e* to carry out the force measurements at the respective support bearing 18 (FIGS. 1, 3). It is advantageous in this case if, at the support bearing(s) 18 for the springy elastic support of a bearing housing 19 on a section 20 of the machine frame 8, one of the force sensors 11*e* for carrying out the force measurements at the respective support bearing 18 is provided in each case, for example, below the respective support bearing 18 and above the machine frame section 20.

The force sensors 11*a*-11*d* and/or 11*e* are preferably designed for measuring pressure forces.

Figure 4:
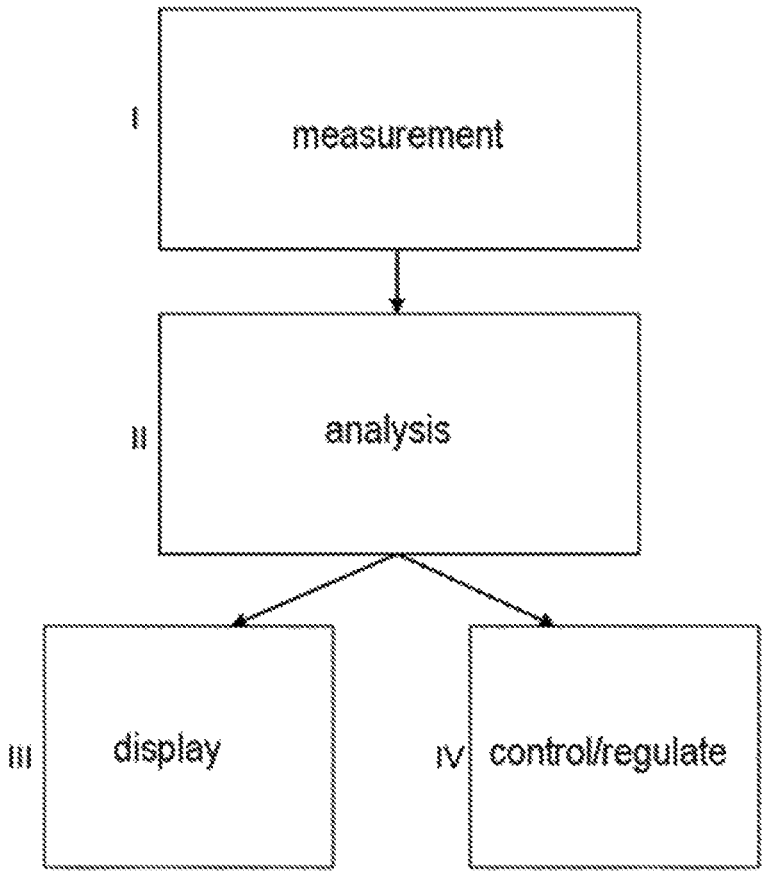
FIG. 4 shows a flow chart.

The force sensors 11*a*-11*e* are preferably furthermore connected via a wired connection or wirelessly, for example, to a control and/or regulating unit 12 of the separator, at which the measurement results thereof are analyzed (step II in FIG. 4). The control unit 12 is preferably designed for the purpose of displaying the ascertained values, for example, at an output unit such as a display screen (step III in FIG. 4) and/or using them for controlling/regulating the operation of the centrifuge (step IV in FIG. 4). In the event of a deviation from a previously stored behavior, for example, in the event of a deviation from one or more target values, a warning signal can be output. Functions such as solid emptyings during operation of the centrifuge can also be controlled and/or regulated on the basis of the measurement data (step IV). The control unit 12 also preferably activates the drive motor 2 (directly or via an interconnected unit).

One of the force sensors 11*a*-11*d* is preferably used at each of the (one-part or multipart) base elements 9*a*, 9*b*, 9*c*, 9*d* for force measurement.

This movement of the separator results from the machine-dynamic state but also the process state of the centrifuge, in particular of the drum 1. The static and dynamic forces acting on the base arrangements 9*a*-9*d* or the support bearings 18 of the machine can be measured via the force measurement under two, three, or four base elements (11*a*-11*d*) or at the support bearings (11*e*).

FIG. 2 illustrates one exemplary type of the arrangement of the force sensors 11*a*-11*d*. A force sensor 11*a* designed as a force washer is provided here on a base element 9*a*. It is arranged between the machine frame 8 and the actual base element 9*a*, which has a round bearing 15 enclosed by a cover 14 as a spring element here. The round bearing 15 is in turn supported on a foundation frame 16, which forms a part of the foundation/floor 10. The elements machine frame 8, round bearing 15, and foundation frame 16 can be connected to one another using one or more bolts 17, which are vertically aligned here. This construction is preferably implemented on at least one or preferably on all of the base arrangements 9*a*-9*d*. A pre-tension is generated in the force sensor 11*a* by fastening nut 13 and bolt 17.

The measuring takes place progressively continuously or at intervals. The data measured by the force sensors 11*a*-11*d* and/or 11*e* are relayed to the control (and preferably regulating) unit 12, where they are analyzed. However, it is also conceivable to record the results of all force sensors and link them with one another suitably and analyze them, to prepare specifications for the regulation therefrom.

The recorded measurement data are compared to target data. At least one control variable is ascertained on the basis of this comparison. Using the control and regulating unit 12, with the aid of the at least one control variable (or multiple control variables), the operation of the centrifuge is influenced so that the regulating variable—the force and/or the deflection at the base elements—is changed so that it assumes a desired behavior.

It is particularly advantageous—as already mentioned—additionally or alternatively to the force measurements at the base elements 9*a*-9*d*, to perform force measurements directly in the vicinity of the drum mounting (force sensors 11*e*) at one or more support bearings 18. This is because the ratio between the measuring signal and the useful signal is significantly improved in this region, because machine frame, drive parts, and motor are not incorporated into the measurement.

It is furthermore conceivable to perform an additional measurement at one or more bases in the horizontal direction and/or an additional measurement during and after emptying of solids through the solid discharge openings 6 (if they are discontinuously closable) (information from machine controller). Inferences about the emptying behavior and the emptying quantity can be drawn by way of a measurement of lateral forces.

Measurements, using which the weight of the centrifuge and/or changes of the weight state of the centrifuge is/are ascertained, can be carried out, for example, in a simple manner using the one or the multiple force sensor(s). It is thus advisable to perform at least one first reference measurement using an empty drum (without product). In an ideal operating state having a drum charged with product, a second measurement can then be performed. Deviations from these two states can then be ascertained and displayed. One cause of deviations from the desired states after ending operation, but also in running operation, can be caked-on material in the drum interior. It can therefore make sense to conclude an increased weight in the drum if a limiting value is exceeded. In this state, it is reasonable to initiate a countermeasure, for example, solid emptying or in the specific case even an interruption of the process to carry out a CIP cleaning. According to one variant, in contrast, serious bearing damage and/or imbalances or the like are also ascertained on the basis of the measurement data.

Known frequencies (motor speed, drum speed, bearing rollers, bearing cage) can be filtered out to improve the quality of the useful signal. For example, force washers from HBM and shear force transducers from BROSA are suitable as force sensors.

The measurement of the forces is preferably performed progressively or at intervals which are less than or equal to one minute.

The method according to the invention is suitable for operating a centrifuge, in particular a separator having vertical axis of rotation, in continuous operation, which centrifuge has a separating means such as a separating plate assembly in the drum. Alternatively, the centrifuge can also be designed in another manner, for example, as a solid bowl centrifuge, in particular having a horizontal axis of rotation (not shown here).

Although the present invention has been described above by means of embodiments with reference to the enclosed drawings, it is understood that various changes and developments can be implemented without leaving the scope of the present invention, as it is defined in the enclosed claims.

LIST OF REFERENCE NUMERALS

1 drum
2 drive spindle
3 motor
4 feed line
5*a*, 5*b* drain lines
6 solid discharge openings
7 hood
8 machine frame
9*a*, 9*b*, 9*c*, 9*d* base elements
10 foundation
11*a*, 11*b*, 11*c*, 11*d*, 11*e* force sensors
12 control unit
13 fastening nut
14 cover
15 round bearing
16 foundation frame
17 bolts of the round bearing
18 support bearing
19 bearing housing
20 machine frame section

The invention claimed is:

1. A method for monitoring, controlling, or regulating operation of a continuous operation centrifuge during centrifugal processing of a product, the method comprising:

performing, once or repeatedly, a calibration run to generate a first reference measurement based on force measurements made when a drum of the centrifuge is empty and a second reference measurement when the drum is charged with a product;

continuously operating the centrifuge;

performing, while the centrifuge is continuously operated, force measurements of the centrifuge using one or more force sensors that measure a weight of the centrifuge and/or changes in weight of the centrifuge;

analyzing the force measurements to determine;

a deviation from a predefined behavior based on the first or second reference measurement;

determining at least one control variable based on the determined deviation;

controlling and/or regulating, while the centrifuge is continuously operated, the at least one control variable based on the determined deviation so as to control or regulate the operation of the centrifuge, wherein the at least one control variable is at least one of a speed of the drive spindle and pressure in a feed line or in one or more drain lines of the drum, wherein the centrifuge comprises at least the drum rotatable by a drive spindle, a drum mounting, a drive motor, the feed line, which is configured to supply a product to be processed into the drum, the one or more drain lines, and discontinuously closable solid discharge openings configured to discharge solids out of the drum.

2. The method of claim 1, wherein the force measurements are performed using one or more force transducer(s).

3. The method of claim 1, wherein the force measurements are performed using one or more force washers.

4. The method of claim 1, wherein the force measurements are performed using one or more shear force transducers.

5. The method of claim 1, wherein the one or more force sensors are arranged at points of the centrifuge at which at least a weight of the rotating system or the entire centrifuge is elastically supported against a counter bearing, so that limited vertical or horizontal movements of a respective supported system occur.

6. The method of claim 1, wherein the centrifuge drum has one or more base elements that are entirely or partially elastic, and one or more of the base elements is assigned one of the force sensors.

7. The method of claim 6, wherein each one of the force sensors is arranged above or below a springy bearing of the respective base element.

8. The method of claim 1, wherein the drum has one or more support bearings in a vicinity of the drum mounting, and at least three of the support bearings are assigned one of the force sensors, wherein the force sensors are arranged circularly-symmetrically.

9. The method of claim 1, wherein the centrifuge drum is provided with support bearings to support a bearing housing on a machine frame section, and the force sensor is arranged below or above the support bearing.

10. The method of claim 1, wherein the force measurements are performed progressively continuously.

11. The method of claim 1, wherein the force measurements are performed at intervals.

12. The method of claim 1, wherein the force measurements are performed at intervals that are less than or equal to one minute.

13. The method of claim 1, wherein the at least one control variable further comprises processed volume stream.

14. The method of claim 1, wherein the at least one control variable further comprises feed quantity.

15. The method of claim 1, wherein the at least one control variable further comprises a point in time for emptying at a drain coupled to the one or more drain lines.

16. The method of claim 1, wherein the at least one control variable further comprises an emptying quantity at a drain.

17. The method of claim 1, the at least one control variable further comprises an emptying frequency at a drain.

18. The method of claim 1, wherein one or more upper force limits are defined, and the centrifuge is regulated so that one of the upper force limits is not exceeded or fallen below depending on time intervals.

19. The method of claim 1, wherein the force measurements are performed during and after emptying of solids from the solids discharge opening while the centrifuge is continuously operated.

20. The method of claim 19, wherein, responsive to the force measurements performed during and after emptying of solids from the solids discharge opening, discharging solids from the discontinuously closeable solids discharge openings.

* * * * *